United States Patent [19]

Lacis et al.

[11] 4,149,130

[45] Apr. 10, 1979

[54] MINIATURE MERCURY CONTACT REED SWITCH CONSTRUCTION

[75] Inventors: Laimons Lacis, Bloomfield; Steven Horvath, Irvington, both of N.J.

[73] Assignee: Gordos Corporation, Bloomfield, N.J.

[21] Appl. No.: 870,947

[22] Filed: Jan. 20, 1978

[51] Int. Cl.[2] ..... H01H 51/06

[52] U.S. Cl. ..... 335/154; 335/55

[58] Field of Search ..... 335/47, 48, 55, 57, 335/58, 151, 154

[56] References Cited

U.S. PATENT DOCUMENTS

| | | | |
|---|---|---|---|
| 3,317,869 | 5/1967 | Funke | 335/154 |
| 3,327,262 | 6/1967 | Bongard et al. | 335/154 |

*Primary Examiner*—George Harris

*Attorney, Agent, or Firm*—Dann, Dorfman, Herrell and Skillman

[57] ABSTRACT

A movable magnetic armature of a size to nest within stepped faces on a fixed magnetic pole piece and on the armature support, respectively, is attached to the armature support by a conductive spring member which normally biases the armature away from the nested position in which it contacts a contact and stop member on the fixed pole. Imposition of the magnetic field causes the armature to move into closed contact position. The position of the armature even when in open contact position is close to the steps of the fixed pole piece as well as the armature support providing a low reluctance, short throw, quick action switch.

14 Claims, 9 Drawing Figures

MINIATURE MERCURY CONTACT REED SWITCH CONSTRUCTION

BACKGROUND OF THE INVENTION

The present invention relates to a miniature magnetic relay and preferably one of a mercury wetted contact type. In particular, it relates to a reed switch which has superior characteristics over other miniature reed switches of similar size.

In the prior art, it has become a practice to provide an offset in the pole piece whereby the end thereof which bears the electrical contact is laterally offset from the axis. The purpose is to afford a configuration of which will minimize the amount of magnetic force required to close the switch contacts which are normally open in the absence of a magnetic field. While some improvement has apparently been achieved by this type of construction, results have been less than hoped for.

SUMMARY OF THE INVENTION

The present invention is directed to a device which does minimize the amount of energy required to actuate the reed switch and which at the same time provides a quick acting switch for applications which cannot tolerate delays. More specifically, the present invention involves a reed switch construction which takes maximum advantage of magnetic characteristics by a novel geometry.

More specifically, the present invention concerns a magnetic reed switch having an insulating support structure. A first conductive magnetic member providing a fixed pole is supported by the insulating support structure and provides one switch terminal. The first conductive magnetic member has a stepped construction provided by a magnetic conductive extension laterally offset from axially alignment with the rest of the member and extending parallel to the axial direction away from the support. A second conductive magnetic member provides an armature support element supported on the insulating support structure and generally aligned with but separated from the first magnetic member and provides the other switch terminal. The second conductive magnetic member has a stepped construction provided by magnetic conductive extension laterally offset from the axial alignment to the same side as the extension of the first conductive magnetic member. A magnetic armature member extends between said first and second magnetic members and is of such length and position that it overlaps the axial extending portions of each conductive magnetic member and fits within the step of each without touching. A spring support member connects the armature support element and the armature, and in the absence of a magnetic field in its unstressed condition, positions the armature spaced away from the first magnetic member. The spring support provides a flexible connection which permits the armature to move into improved alignment with said first and second magnetic members to a reluctance minimizing position in the presence of a magnetic field. A conductive contact on the extension of the first conductive magnetic member projecting toward the axis provides an electrical circuit completing contact for the fixed pole and mechanical spacing means limiting the approach of the armature to the magnetic extension.

In preferred embodiments of the invention, the insulating support structure is a glass or other insulating envelope and in which mercury is placed which may be evacuated, gas filled and hermetically sealed. The structure is such that the armature and the conductive contact with which it cooperates are wet by the mercury, and the structure is provided with means assuring access of the mercury to the region of the armature opposed to the contact.

PREFERRED EMBODIMENT

For a better understanding of the present invention reference is made to the accompanying drawings in which:

FIG. 1 is a view of a switch of the present invention viewed from that side which enables the showing of the laterally offset extensions of the fixed magnetic conductive members;

FIG. 1*a* is a separate detail view of similar orientation as FIG. 1 of the inner portion of the armature support member;

FIG. 1*b* is a perspective view of the fixed pole element of the structure of FIG. 1;

Figure 1B:
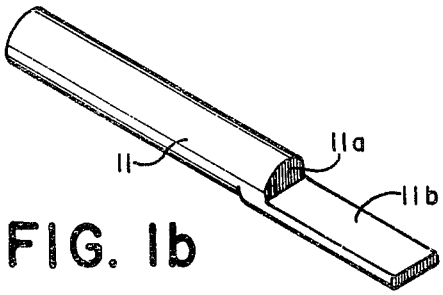
Figure 3B:
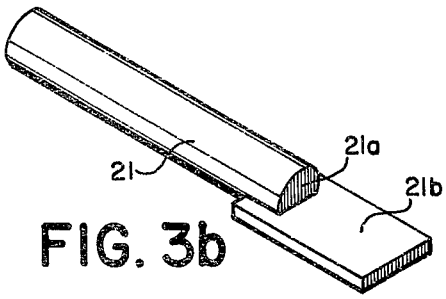
FIG. 3 is a view similar to FIG. 1 of a modified structure in accordance of the present invention.
Figure 3:
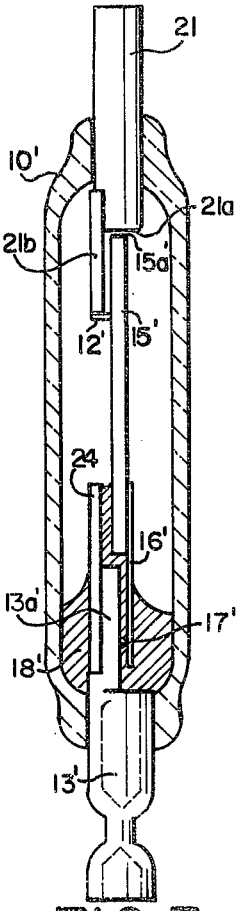
Figure 4:
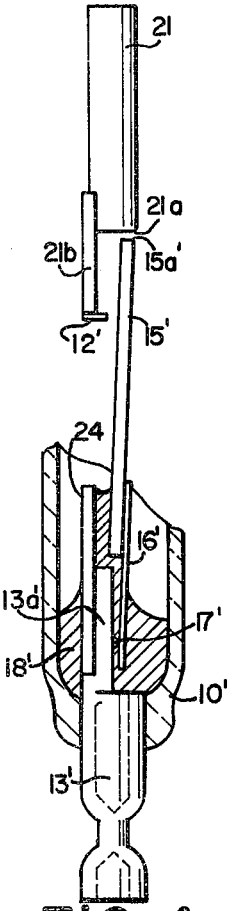
Figure 5:
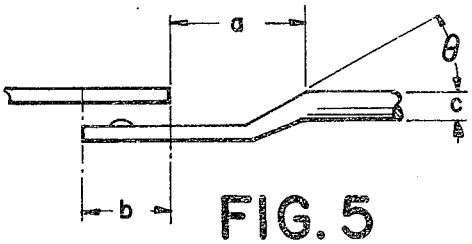
Figure 6:
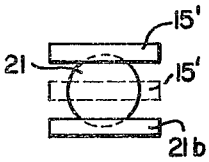

FIG. 3*b* is perspective view similar to FIG. 1*b* showing the fixed pole piece of FIG. 3;

FIG. 4 is a view of the structure of FIG. 3 showing the armature in unactuated open contact position;

FIG. 5 is a view showing the contact region of a miniature reed relay of the prior art, and FIG. 6 is a diagramatic view which is actually an axial cross section through the armature and fixed pole extension showing the armature in alternative positions.

Figure 1:
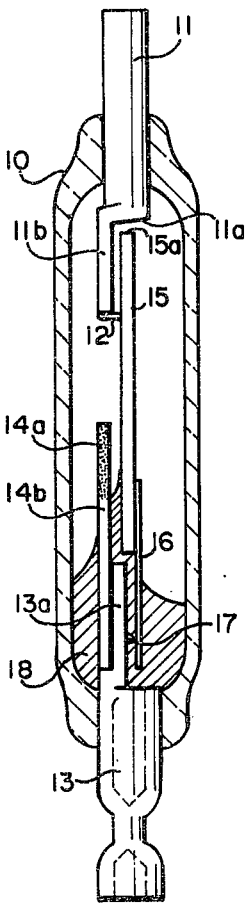
Figure 2:
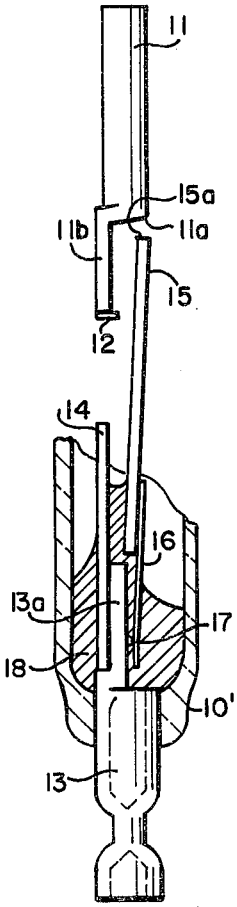
FIG. 2 is a view similar to FIG. 1 but showing the armature in unactuated open contact position.
Figure 1A:
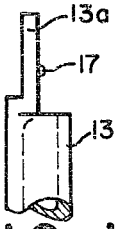

Referring now to FIGS. 1 and 2, the miniature reed switch requires an insulating support structure between the magnetic conductive members. In this case, the insulating support structure is supplied by a glass or ceramic envelope 10 which supports the magnetic conductive member 11 providing, a fixed pole which carries conductive contact 12. Spaced from the first magnetic conductive member 11 is a second conductive magnetic member 13 providing an armature support element. As shown, the magnetic armature 15 is connected to the armature support member by resilient spring member 16. In this case, the armature support member is a tube 13 which is formed as shown in FIG. 1*a* so that the actual support of the spring 16 is provided by an elongated ridge or projection 17 across the solid flat surface of 13*a*. The glass envelope is gas filled through the tube provided by the second conductive magnetic member 13 which then is pinched off and welded as shown in FIG. 1 in order to retain the internal environment. Before the pinching off is done, however, the mercury needed for the switch is introduced through the tubing, and as illustrated in the positions shown, accumulates around the armature support member. FIGS. 1*a* and 1*b* show some special construction involved in this particular switch. As previously eluded to, FIG. 1 shows the way in which the tubing member 13, which is sealed through the glass envelope 10, is shaped. As shown, the only cutting of tubing 13 is done across and through to near its center to preserve access to the interior of the enclosure when forming the extension 13*a* by means of compressing magnetic material on both sides to form the projection 17 on one side and to provide a mounting region on the other side for an extension 14 which is flat, laterally offset from the axial line of the conductive magnetic members 11 and 13 but parallel to the axis. As indicated by the stipling in the drawing, the upper part 14*a* of the extension 14 is provided with a coating which is not readily wet by the mercury 18 while the lower part 14*b* is left in its natural state which enables it to be wet by the mercury. As indicated, capillary attraction tends to cause mercury to rise in the region between the spring member 16 and the parallel portion 13*a* of armature support member 13. The armature is designed as shown in FIG. 1 to fit snuggly within the shoulder formed by the extension 14 and portion 13*a*, and in the closed contact position, shown in FIG. 1, the extension 14 and the armature 15 are close enough to one another to cause the mercury to rise between them by capillary action. The armature 15 itself is preferably provided with capillary grooves which carry mercury upwardly to the region of the contact 12 so as to provide the needed supply of the contact.

As shown in FIG. 1*b*, the stationary pole 11 is also provided with the distinctive shape which may be done by swaging its inside end into a flattened area 11*b* offset from but generally parallel to the axis through members 11 and 13. Extension 11*b* is also laterally offset on the same side as extension 14 of the armature support member. In the swaging operation as steep an angle is provided as possible to form shoulder 11*a*. As will be observed, the contact element 12, which is preferably composed of non-magnetic but conductive material may be a mercury non-wettable bar extending from extension 11*b* back toward the axis so that it acts as a stop for the armature 15 or a spacer preventing a closer approach between armature 15 and extension 11*b* than that shown in FIG. 1 only the end of 12 facing 15 is mercury-wettable. The results of the construction is that the armature may be close spaced, over a very long gap in each case, to each of the conductive magnetic members 11 and 13 of which the 11 is not mercury wettable. The proximity of the ends of the armature to the shoulders of members 11 and 13 is also part of the invention. By keeping spacing small in this way, magnetic reluctance is minimized. Yet when a magnetic field is removed, the action of the thin leaf spring immediately returns the armature to the position shown in FIG. 2 separating the contacts. The action of the mercury between the leaf spring and the armature on one hand and the armature support member extension 13*a* and extension 14 on the other, provides a damping action prevention continued hunting or vibration of the armature. The extension of the armature 14 may be considerable, provided, however, that it is desirable not to have the pool of mercury extend so far as the end of the extension 14 in this case. In order to avoid that the end of 14*a* of extension 14 is provided with a coating which is not readily wet by mercury, whereas the lower portion 14*b* of the extension 14 is able to be wet by the mercury. As will be seen, the armature fits, or nests, rather snugly within the fixed magnetic structure. When the magnetic field is applied, parallel close spacing of the armature 15 and extensions 11*b* and 14 is achieved. Contact 12 used as a spacer or a stop and design of positioning spring support 17 and the spring itself make it possible to keep the armature generally parallel and close spaced to the extensions when it engages the stop.

FIGS. 3 and 4 and FIG. 3*b* show a modified form of miniature reed switch in accordance with the present invention. The principal difference is in the construction of the extension of the stationary pole piece. In this case, the conductive magnetic element 21 is provided with a shoulder just inside the envelope 10' to which is welded a flat extension 21*b* as best seen in FIG. 3*b*. This arrangement has some advantages over the one-piece construction of FIGS. 1, 2 and 1*b*. One advantage is that the machining necessary to perform the cut-out of the material in member 21 can be combined with cutting the shoulder 21*a* quite square thus providing somewhat more uniform gradient of magnetic flux through the end of the armature.

Another significant advantage is that a separate blade 21*b* welded in place can be of increased width without sacrificing the overlap area and the thickness of the blade and enables welding more than one contact bar 12 on the end.

Such multi contact arrangement with each contact having much smaller mercury wetted end (or area) requires shorter travel of the armature to interrupt the mercury dynamic bridge when opening the conductive contact, thus contributing to the magnetic sensitivity and operating stability of the switch.

Also in FIG. 3 and FIG. 4, the extension of the armature support member (13*a'*) is shown as a shorter extension 24 which does not have a non-wettable region corresponding to 14*a*. If the extension is elongated as in FIG. 1, the non-wettable arrangement is desirable to prevent a flooding of the contact area with mercury. In all other respects, the structure of FIGS. 3 and 4 is similar to the structure of FIGS. 1 and 2 and corresponding parts are identified with the same number designators with the addition thereto of primes.

In general, it will be seen that the switch of the present invention provides increased operational sensitivity at low magnetic force levels by effectively minimizing the magnetic reluctance between the switch components all of which is due to a geometry which permits low magnetic reluctance, both in the open and closed positions as seen in FIGS. 2 and 4. The invention not only keeps the magnetic members in relatively close proximity to one another by their geometry, but the extension elements and the armature are preferably all made flat and parallel to one another further lowering reluctance. The diameters of the magnetic conductive elements are also kept at a maximum for the size of the components. On top of this, the dimensions selected in the nesting geometry are such that the armature effectively lies within the shoulders at all times so that the reluctance of the magnetic path is relatively low, even in open contact position. As seen in FIG. 6, for example, the armature 15' and its relation to extension 12' changes somewhat, but in all positions it overlaps the magnetic conductive stationery pole piece 21 and its air gap is extremely small, whether in the open contact position shown in solid lines, or in the closed contact position shown in the dotted line.

The difference in the prior art arrangement now becomes apparent. For in such an arrangement the diameter of the stationery pole was not maximized in the region of the contact area. In the prior art, what might be characterized as an extension provided a limited area overlap of magnetic parts. Thus, the distance of the armature from the stationery pole piece is shown dimensionally as "a" and was substantially greater than that employed in the present invention. Moreover, the connection between the stationery pole piece and its extension was at a rather oblique angle $\theta$ which made the nesting arrangement of the present invention impossible to apply. The thickness of the stationary pole piece "c" itself was minimal in order to facilitate its support by the envelope and the area of contact overlap "b" which constituted the magnetic gap was relatively short. Thus, in the prior art was none of the features of the present invention employed or considered to minimize reluctance. The armature nesting feature of the present invention was not possible and overlap occured really at only one end. Particularly where the armature needs to be hinged by a lightweight spring and non-magnetic material, the extension of the armature support member to parallel the armature as in the present invention is a very desirable reluctance minimizing provision. The problems arising because of extending the extension 14 too far can be offset by using chrome oxide or some other coating on the surface of the end of the extension to prevent mercury wetting without losing the magnetic properties of the extension. Minimizing the space between the extension 14 and the armature 15 is primarily a matter of mechanical support for the armature providing that the throw of the armature is not overly great and properly dimensioning the armature support and the ridge carrying the spring. It should be borne in mind that in design of a switch of this sort the holding force of mercury 18 which is moved into the gap between extension 14 and armature 15 may be considerable and must be overcome by the restoring force of the spring 16. Where magnetic materials are placed together as is the case with extension 14 and the armature support member 13 or in the FIGS. 3 and 4 construction with extension **21*b* and the fixed pole piece 21, the reluctance in the joint if carefully made is practically negligable and need not be considered. The effect is further minimized by providing considerable overlap in making the joint which also has mechanically desirable aspects. The free end of the armature 15 is positioned very close to the stationary pole piece 11 even when the contacts are open. The shoulder 11*a* (or 21*a*) by being positioned as close as possible to the end of the armature causes a flux concentration which aids in pulling the armature into closed contact position. That is, the gap between the shoulder 11*a* and the end of the armature 15*a* is desirably minimized so that in this regard, the structure of FIGS. 3 and 4 provide an advantage. In some designs, it may not be possible to make the shoulder 11*a* as "square" even as that of FIG. 1**. It will be understood that some of the advantage is achieved according to the present invention, even if a distinct sharp shoulder is not provided, by keeping the armature as closely bracketed as reasonably possible with a given pole piece shape.

All of the features taken together make this miniature switch construction able to operate at unprecedentedly low magnetic field intensity levels. However, the construction also provides very short operating time which tends to remain constant over a long period of time and over a wide operating frequency range. The timing to a large extent is facilitated by keeping selected dimensions extremely small, by keeping the elements of the switch compact and keeping the masses of moving parts very small. The use of the mercury in the switch in practice has proved to be quite advantageous providing a highly desirable damping effect but without overdamping in any regard.

Various modification to the structure of the present invention have been suggested by the disclosure herein. Other modifications will occur to the man skilled in the art. All such modifications within the scope of the claims are intended to be within the scope and spirit of the present invention.

I claim:

1. A miniature reed switch comprising:

an insulating support structure, a first conductive magnetic member providing a fixed pole supported by the insulating support structure and supporting one switch terminal and having a stepped construction provided by a magnetic conductive extension laterally offset from axial alignment with the rest of the member and extending parallel to the axial direction, a second conductive magnetic member providing an armature support element supported on the insulating support structure and generally aligned with but separated from the first magnetic member, providing the other switch terminal and having a stepped construction provided by a magnetic conductive extension laterally offset from axial alignment to the same side as the extension of the first conductive magnetic member, a magnetic armature member extending between said first and second magnetic members and of such length and position that it overlaps axial extending portions of each conductive magnetic member and fits within the step of each without touching, a spring support member connected between the armature support element and the armature and supporting the armature in a position spaced away from the first conductive magnetic member in the absence of a magnetic field in its unstressed condition and providing a flexible connection which permits the armature to move into improved alignment with said first and second magnetic members to a reluctance minimizing position in the presence of a magnetic field, and a conductive contact on the extension of the fixed first conductive magnetic member projecting toward the axis and providing an electrical circuit completing contact for the fixed pole and mechanical spacing means limiting the approach of the armature to the magnetic extension.

2. The miniature reed switch of claim 1 in which the insulating support structure is an insulating envelope enclosing the armature but through which the first and second conductive members extend, a conductive liquid is contained in the envelope and provides a conductor through which the electrical circuit is completed at the contact, and means is provided for supplying liquid to the contact area.

3. The reed switch of claim 2 in which the first and second conductive magnetic members are both provided with an approximate right angle step at the extension defining the end bounds of a region closely confining the armature.

4. The reed switch of claim 3 in which the spring support member urges the armature to a position adjacent the edge of the step of the first conductive magnetic member so that the armature is thereby close spaced to the fixed pole piece at all times.

5. The reed switch of claim 2 in which the conductive liquid is at least in major part mercury and the envelope is at least partially evacuated, and backfilled with gas, one of the magnetic conductive members being a sealed off tube through which exchange of internal environment took place.

6. The reed switch of claim 2 in which the extension of the first conductive member is formed of the same piece.

7. The reed switch of claim 6 in which the extension of the first conductive member is formed of a separate piece fixed with a minimum reluctance joint to the main first conductive member.

8. The reed switch of claim 2 in which the conductive contact on the extension of the fixed first conductive member is a member fixed to the end of the extension.

9. The reed switch of claim 8 in which the contact is fixed to a face of the extension generally transverse to the axis and overlaps and extends the end of the extension.

10. The reed switch of claim 8 in which the contact limits the approach to the armature to such a position that the armature is generally parallel to the extension.

11. The reed switch of claim 10 in which the spring support for the armature is fixed to the armature support member near its center and in a position which assures that armature is always close spaced to the step and generally parallel to the extension of the second conductive magnetic member in closed contact position.

12. The reed switch of claim 3 in which the structure is attached to the armature support member in such a manner as to provide a capillary path between the spring and support extending to space between the extension and the armature whereby mercury is supplied to the armature to be delivered to the contact area.

13. The reed switch of claim 12 in which the extension to the armature support member is extended beyond the level on the armature desirable as a limit to mercury surface tension forces and possible pumping and is coated with a material which mercury will not wet.

14. The reed switch of claim 2 in which the armature support structure is the air evacuation tube which is reduced to approximately its diameter point parallel to the extension in a generally axial step and the armature is supported on the structure by a narrow support which spaces the armature from the support member, said armature being connected to the spring to lie on the extension side of the spring just above the step in order to preserve close spacing of the armature and the armature support elements yet provide room for movement.

* * * * *